US006935581B2

(12) United States Patent
Titinet

(10) Patent No.: US 6,935,581 B2
(45) Date of Patent: Aug. 30, 2005

(54) SHOWER HEAD WITH NOZZLES HAVING SELF CLEANING TIPS

(75) Inventor: Gianni Clerico Titinet, Borgosesia (IT)

(73) Assignee: Visentin USA, Ossian, IN (US)

( * ) Notice: Subject to any disclaimer, the term of this patent is extended or adjusted under 35 U.S.C. 154(b) by 0 days.

(21) Appl. No.: 10/277,342

(22) Filed: Oct. 22, 2002

(65) Prior Publication Data

US 2003/0038189 A1 Feb. 27, 2003

Related U.S. Application Data

(63) Continuation-in-part of application No. 09/912,181, filed on Jul. 24, 2001.

(51) Int. Cl.[7] ..... A62C 2/08

(52) U.S. Cl. ..... 239/548; 239/533; 239/533.13; 239/602; 239/591; 239/558; 239/DIG. 12

(58) Field of Search ..... 239/548–568, 239/602, 526, DIG. 12, 106, 107, 530, 591, 437, 533

(56) References Cited

U.S. PATENT DOCUMENTS 2,402,741 A * 6/1946 Draviner ..... 239/602
3,214,102 A * 10/1965 Meyer ..... 239/107
3,510,065 A * 5/1970 Gigantino ..... 239/590
3,547,352 A * 12/1970 Hadsel ..... 239/602
4,094,468 A * 6/1978 Volle ..... 239/553
5,074,471 A * 12/1991 Baumbarten et al. ..... 239/602
5,174,506 A * 12/1992 Scheidler ..... 239/DIG. 12
5,228,625 A * 7/1993 Grassberger ..... 239/602
5,246,301 A * 9/1993 Hirasawa ..... 401/28
5,405,089 A * 4/1995 Heimann et al. ..... 239/533.14
6,250,572 B1 * 6/2001 Chen ..... 239/602
6,328,228 B1 * 12/2001 Bossini ..... 239/390

* cited by examiner

*Primary Examiner*—Dinh Q. Nguyen
(74) *Attorney, Agent, or Firm*—Baker & Daniels

(57) ABSTRACT

A shower head having a plurality of nozzles, with the exterior finish of both the shower head housing and the nozzles being consistent. For example, both the shower head and the nozzles may have either a chrome or a brass exterior finish. The nozzles of the shower head of the present invention each include a nozzle insert positioned therein, with the nozzle insert having a flexible nozzle tip protruding from the nozzle. Each nozzle insert includes an passageway in fluid communication with the water inlet of the shower head whereby water introduced into the shower head is ejected from the shower head through the passageway in the nozzle insert. The flexibility of the nozzle tip provides a convenient mechanism for eliminating build-up of, e.g., calcium or other deposits by manually flexing the nozzle tip.

21 Claims, 6 Drawing Sheets

SHOWER HEAD WITH NOZZLES HAVING SELF CLEANING TIPS

CROSS-REFERENCE TO RELATED APPLICATIONS

This is a continuation-in-part of co-pending application Ser. No. 09/912,181, filed Jul. 24, 2001.

BACKGROUND OF THE INVENTION

1. Field of the Invention

The present invention relates to a shower head, and, more particularly, to a shower head having a plurality of nozzles with self cleaning tips.

2. Description of the Related Art

Conventional shower head designs include those having a shower head housing with passageways allowing water sprays to flow from the shower head as well as designs having a shower head housing with passageways accommodating external nozzles mounted thereon through which water sprays are formed. Furthermore, shower heads having a surface with a plurality of passageways, or nozzle orifices which utilize a backing disk having a plurality of resilient and flexible nozzle tips protruding through the nozzle orifices are known. The resilient nozzles of these known shower heads allow for convenient elimination of the build-up of calcium or other deposits by manually flexing the resilient nozzles when it appears that material is collecting therein. In these known shower heads, the entire nozzle is formed of a resilient and flexible rubber which does not match the finish of, e.g., a brass or chrome shower head.

SUMMARY OF THE INVENTION

What is needed in the art is an aesthetically pleasing nozzle for affixation to a shower head having, e.g., a chrome or brass finish, which nozzle has an identical finish to the external shower head housing and which includes a self cleaning tip for conveniently eliminating the build up of, e.g., calcium or other deposits.

The present invention provides a shower head having a plurality of nozzles, with the exterior finish of both the shower head housing and the nozzles being consistent. For example, both the shower head and the nozzles may have either a chrome or a brass exterior finish. The nozzles of the shower head of the present invention each have a nozzle insert positioned therein, with the nozzle insert having a flexible nozzle tip protruding from the nozzle. Each nozzle insert includes an passageway in fluid communication with the water inlet of the shower head, whereby water introduced into the shower head is ejected from the shower head through the passageway in the nozzle insert. The flexibility of the nozzle tip provides a convenient mechanism for eliminating the build up of, e.g., calcium or other deposits by manually flexing the nozzle tip.

The shower head of the present invention advantageously provides nozzles having an exterior finish consistent with the exterior finish of the shower head to which they are attached and which include flexible self cleaning tips.

An advantage of the present invention is the ability to provide a nozzle having a consistent finish with respect to the shower head to which it is attached and which includes a self cleaning tip. The self cleaning tip of the shower head is formed in a rubber insert positioned in the nozzle of the present invention, which rubber insert advantageously has a more precise water outlet passageway relative to a water outlet passageway formed directly in a metallic nozzle. The rubber outlet can be formed with a variety of surface finishes, and in a variety of colors to provide an aesthetically pleasing contrast to the matching finish of the nozzle and shower head.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate exemplary embodiments of the invention, and such exemplifications are not to be construed as limiting the scope of the invention in any manner.

DETAILED DESCRIPTION OF THE INVENTION

Figure 1:
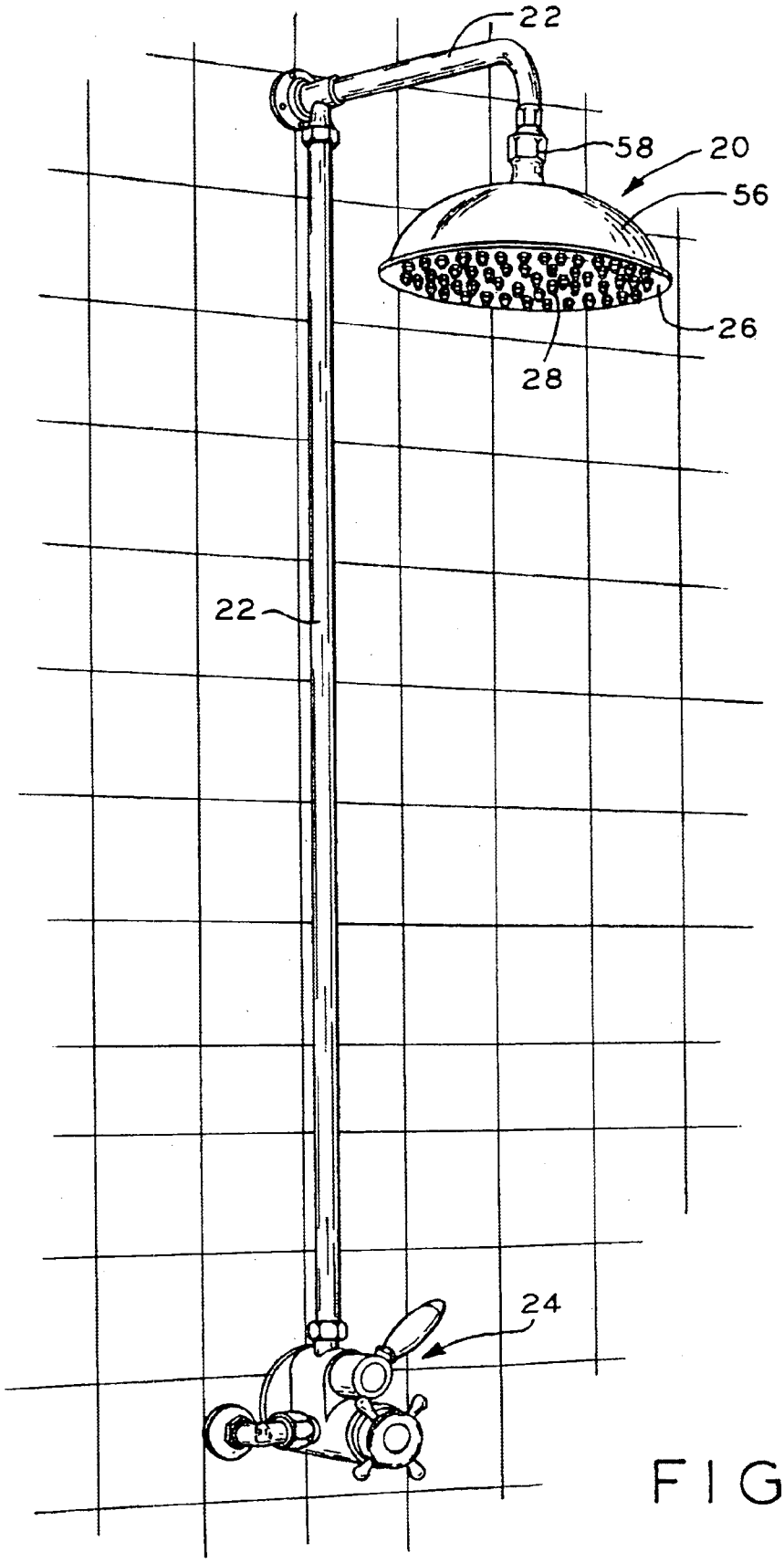
FIG. 1 is a perspective view of a shower fixture including a shower head in accordance with the present invention.

Referring now to the drawings and particularly to FIG. 1, shower head 20 in accordance with the present invention is generally illustrated as connected to a shower fixture including water pipes 22, and temperature and flow control handles 24. As illustrated in FIG. 1, shower head 20 includes housing 56 operably connected to water pipes 22 via water inlet 58. Shower head housing 56 further includes nozzle plate 26 connected thereto. Nozzle plate 26 accommodates a plurality of nozzles 28 affixed thereto.

Figure 2:
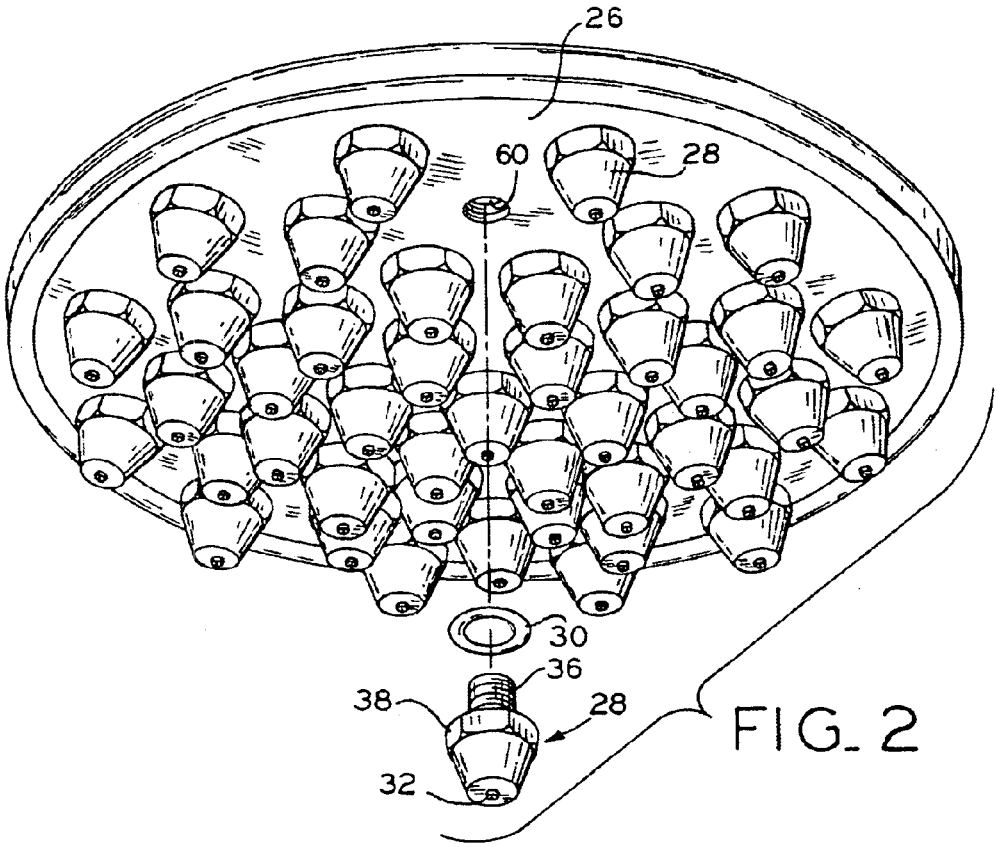
FIG. 2 is an exploded view of a nozzle plate with a plurality of nozzles mounted thereon.
Figure 3:
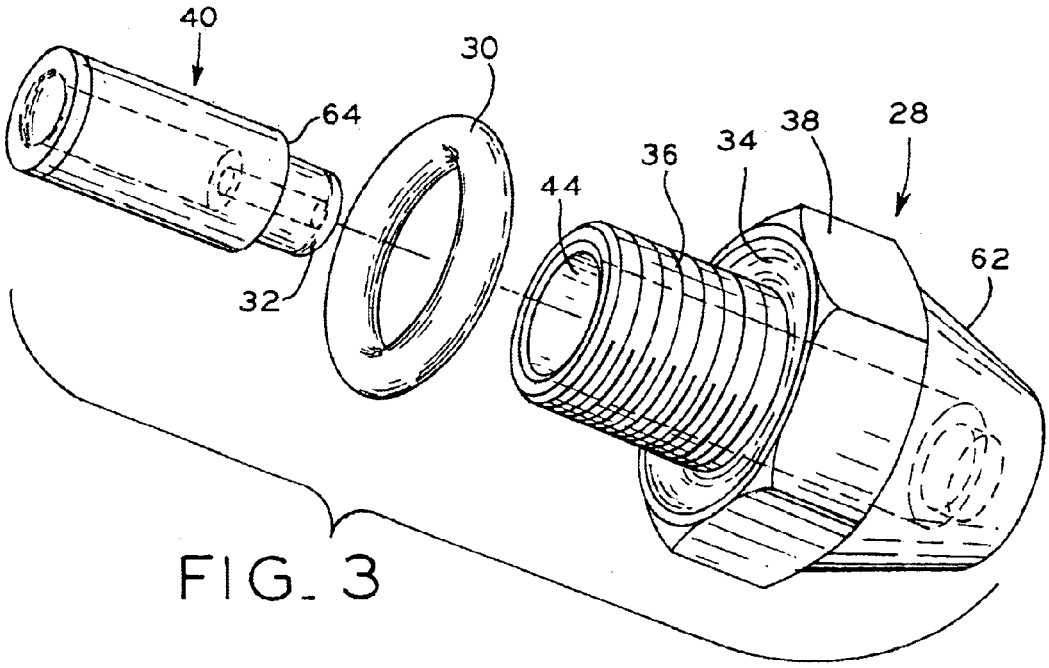
FIG. 3 is an exploded view of a first embodiment nozzle and nozzle insert in accordance with the present invention.

FIG. 2 illustrates nozzle plate 26 in further detail. As illustrated in FIG. 2, nozzle plate 26 includes a plurality of threaded nozzle passageways 60 sized to receive threaded ends 36 of nozzles 28. O-ring 30 is positioned intermediate each nozzle 28 and nozzle plate 26. Referring to FIG. 3, nozzle 28 includes concave O-ring recess 34 sized to accommodate O-ring 30 positioned therein. In construction, O-ring 30 is placed about threaded end 36 of nozzle 28, and threaded end 36 is thereafter threaded into nozzle passageway 60 (FIG. 2) of nozzle plate 26 to affix nozzle 28 to nozzle plate 26. To assemble shower head 20, a tool, e.g., a socket wrench, can be positioned about hexagonal portion 38 of nozzle 28 to tighten nozzle 28 to nozzle plate 26. When nozzle 28 is tightened to nozzle plate 26, O-ring 30 is compressed and forms a tight seal preventing water leakage about the periphery of nozzle 28 abutting nozzle plate 26.

Figure 4:
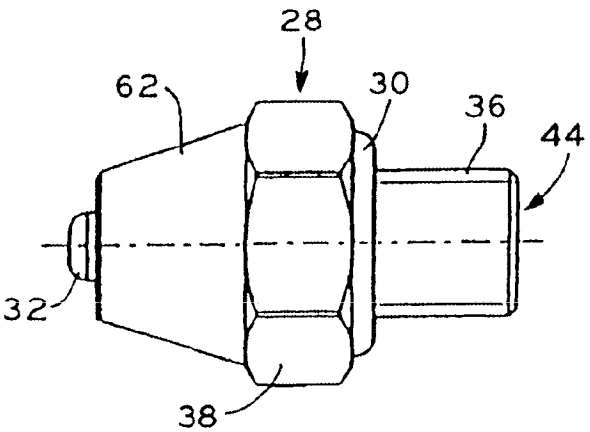
FIG. 4 is a plan view of the nozzle and nozzle insert of FIG. 3.
Figure 5:
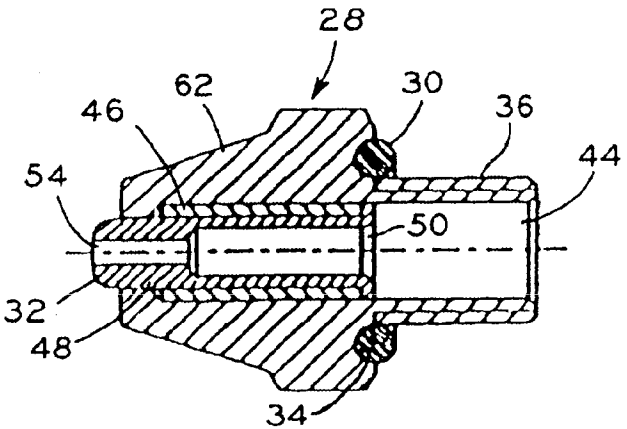
FIG. 5 is a sectional view of the nozzle and nozzle insert of FIGS. 3 and 4.

As illustrated in FIGS. 3–6, each nozzle 28 includes nozzle insert passageway 42 terminating in nozzle tip passageway 52. Nozzle insert passageways 42, 52 accommodate nozzle insert 40 as illustrated, e.g., in FIG. 5. In construction, nozzle 28 and nozzle insert 40 are formed, and nozzle insert 40 is thereafter positioned in nozzle insert passageways 42, 52 as illustrated in FIGS. 4 and 5. When nozzle insert 40 is positioned in nozzle 28, shoulder 64 formed by the end of outer sleeve 46 opposite water inlet 50 abuts shoulder 66 of nozzle 28. Shoulder 66 of nozzle 28 is positioned intermediate nozzle insert passageway 42 and nozzle tip passageway 52. In use, the water pressure developed in water inlet 44 of nozzle 28 forces shoulders 64, 66 into abutting relationship. When nozzle insert 40 is positioned in nozzle 28, with shoulders 64, 66 placed in abutting relationship, nozzle tip 32 protrudes about 1–2 mm from nozzle 28.

Figure 6:
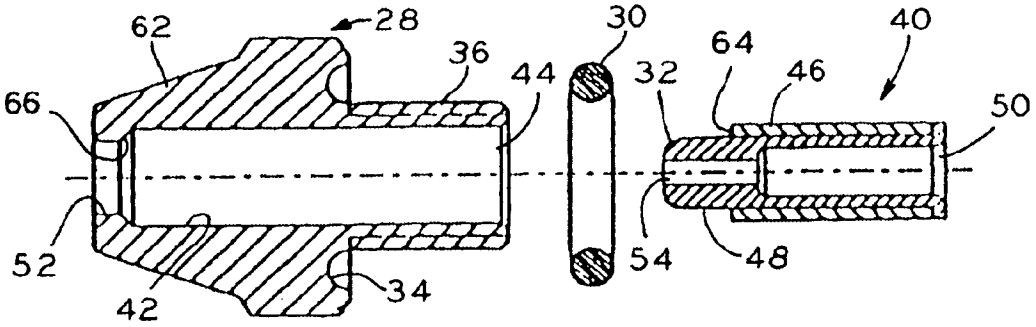
FIG. 6 is an exploded sectional view of the nozzle and nozzle insert of FIGS. 3–5.

Referring to FIG. 6, nozzle insert 40 comprises a co-injected part having inner cannulated member 48 and outer sleeve 46. Inner cannulated member 48 includes nozzle tip 32 with water outlet 54 formed therein. Nozzle insert 40 further includes water inlet 50 which is in fluid communication with the water inlet to shower head 20 i.e., water inlet 58 (FIG. 1) when nozzle 28 is operably positioned on nozzle plate 26. In use, water flows through water pipes 22 (FIG. 1) to water inlet 58 of shower head 20, and thereafter reaches water inlet 44 of nozzle 28, and water inlet 50 of nozzle insert 40 before being ejected through water outlet 54 of nozzle insert 40. As illustrated, e.g., in FIG. 5, the flow path through nozzle 28 and nozzle insert 40 is stepped from water inlet 44 to water outlet 54. The decreasing cross-sectional area from water inlet 44 to water outlet 54 advantageously increases the velocity of the water flowing through nozzle 28 and nozzle insert 40.

Both inner cannulated member 48 and outer sleeve 46 of nozzle insert 40 are formed of a polypropylene based material. Inner cannulated member 48 is formed of a flexible and resilient polypropylene based material having a shore hardness of about 30–50 Sh A (e.g., a polypropylene/EPDM compound). In one exemplary embodiment, inner cannulated member 48 is formed of SANTOPRENE (SANTOPRENE is a registered trademark of AES (Advanced Elastomer Systems)). In another exemplary embodiment, inner cannulated member 48 is formed from EPDM rubber. Outer sleeve 46 of nozzle insert 40 is formed of a harder polypropylene based material (relative to inner cannulated member 48) having a shore hardness of about 90 Sh A or higher. Nozzle tip 32 of nozzle insert 40 is sufficiently flexible and resilient to allow for manual flexing of nozzle tip 32 to conveniently remove calcium or other deposits. Outer sleeve 46 is generally formed of a material of sufficient hardness to provide structural stability and/or rigidity to nozzle insert 40. Since both inner cannulated member 48 and outer sleeve 46 are formed from material based on polypropylene, the two parts have a good bond therebetween no matter that they are obtained by means of a co-injection process (that is with an injection molding press able to inject two different materials at the same time) or by means of an insert molding process where the outer sleeve 46 is used as an insert for the subsequent molding of the inner cannulated member 48.

Shower head 20 has several aesthetically pleasing characteristics, including a consistent exterior finish of both shower head 20 and nozzles 28. For example, both shower head 56 and nozzles may have either a chrome or a brass exterior finish. Furthermore, nozzle insert 40 may be formed with a variety of surface finishes, and in a variety of colors so that nozzle tip 32 provides an aesthetically pleasing contrast to the matching finish of nozzle 28 and shower head 20.

Figure 9:
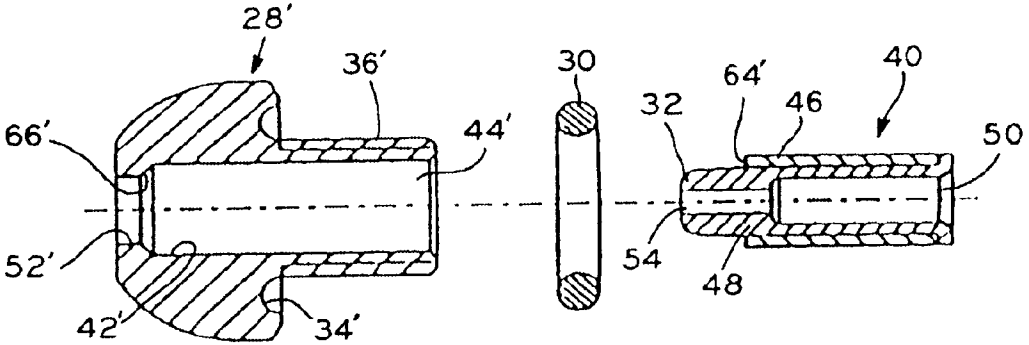
FIG. 9 is an exploded sectional view of the nozzle of FIG. 7.
Figure 7:
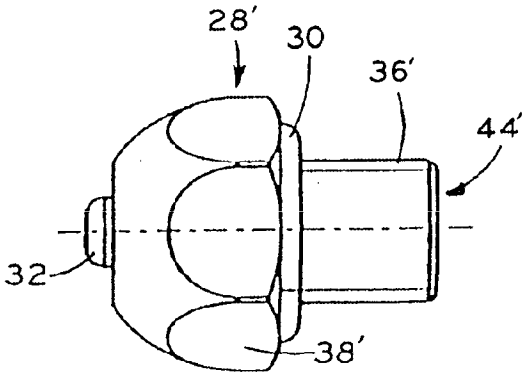
FIG. 7 is a plan view of a second embodiment nozzle in accordance with the present invention.
Figure 8:
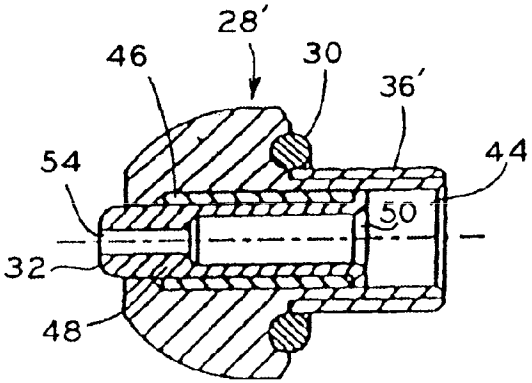
FIG. 8 is a sectional view of the nozzle of FIG. 7.

FIGS. 7–9 illustrate an alternative embodiment nozzle in accordance with the present invention. As illustrated in FIGS. 7–9, nozzle 28' has a different geometry relative to nozzle 28 illustrated, e.g., in FIGS. 4–6. Specifically, nozzle 28 includes hexagonal portion 38 having planar sides generally parallel to the longitudinal axis of nozzle 28, with conical portion 62 extending therefrom, while the body of nozzle 28' includes a curved outer surface with hexagonal portion 38' formed therein. Other than its exterior geometry, nozzle 28' is identical to nozzle 28 and, for the sake of brevity, is not now described in detail.

FIGS. 10–15 illustrate another alternative embodiment nozzle in accordance with the present invention. As illustrated in FIGS. 10–15, nozzle 28" has an exterior geometry similar to nozzle 28 illustrated, e.g., in FIGS. 4–6. However, nozzle 28" utilizes an alternative securement mechanism for securing nozzle 28" to nozzle plate 26" (only a portion of which is illustrated in FIGS. 10–15). As illustrated in FIGS. 11–14, nozzle plate 26" includes nozzle passageway 60". As indicated above, only a portion of nozzle plate 26" is illustrated in FIGS. 10–15. Therefore, while nozzle plate 26" will include a plurality of nozzle passageways 60", only one nozzle passageway 60" is illustrated in FIGS. 10–15. In one exemplary embodiment, nozzle passageway 60" is not threaded as is nozzle passageway 60 described above. Moreover, nozzle 28" does not include a threaded end as do nozzles 28 and 28'.

Figure 11:
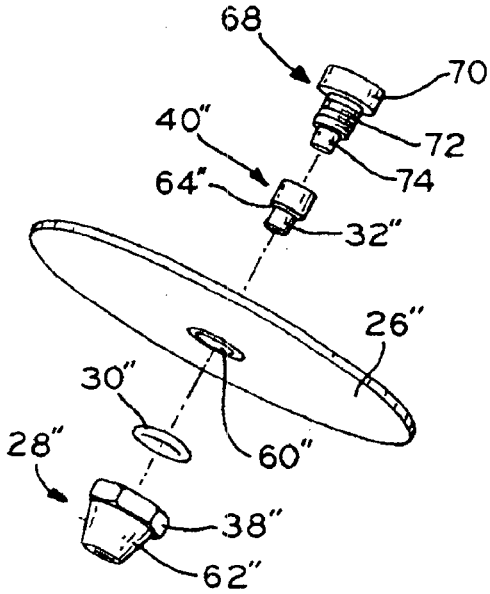
FIGS. 11–14 are exploded perspective views illustrating assembly of the third embodiment nozzle depicted in FIG. 10.
Figure 12:
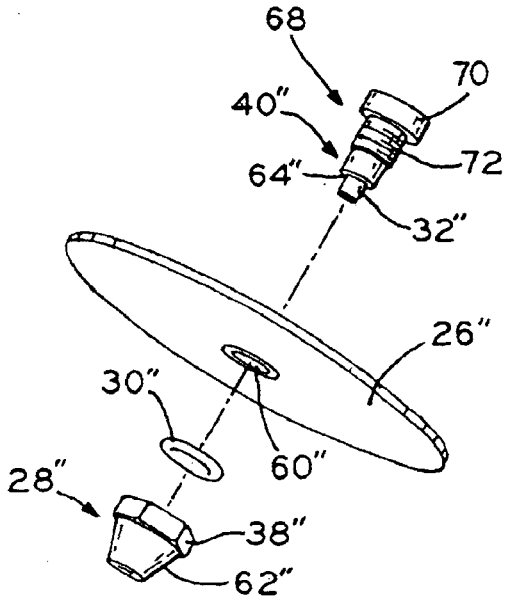
Figure 13:
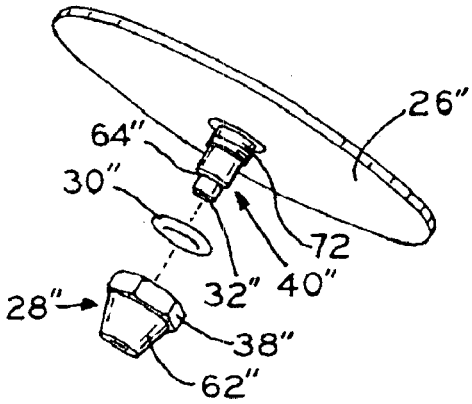

Nozzle 28" is secured to nozzle plate 26" as illustrated in FIGS. 11–14. As illustrated in FIG. 11, nozzle 28" and O-ring 30" are positioned adjacent the exterior of nozzle plate 26" while nozzle insert 40" and adaptor 68 are positioned adjacent the interior of nozzle plate 26". Nozzle insert 40" is positioned over adaptor 68 as illustrated in FIG. 12, with proximal tip 74 of adaptor 68 positioned inside nozzle insert 40". Adaptor 68 is next positioned through nozzle passageway 60", with flange 70 of adaptor 68 abutting the interior of nozzle plate 26". This position is illustrated in FIG. 13. In one exemplary embodiment, nozzle passageway 60" is threaded, and adaptor 68 is threaded therein. In one exemplary embodiment, an O-ring is positioned intermediate flange 70 and the interior of nozzle plate 26".

Figure 10:
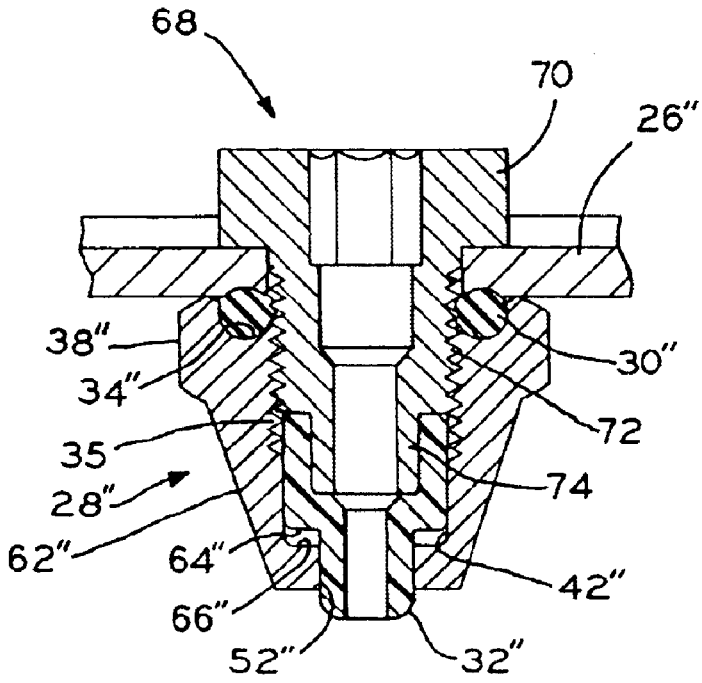
FIG. 10 is a partial sectional view of a third embodiment nozzle in accordance with the present invention.
Figure 15:
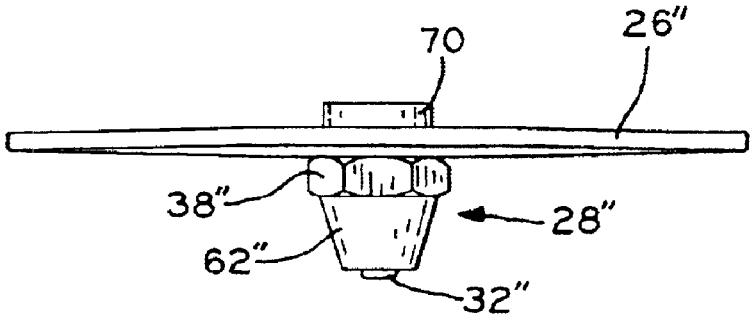
FIG. 15 is a plan view of the nozzle and nozzle insert depicted in FIGS. 10–14.
Figure 14:
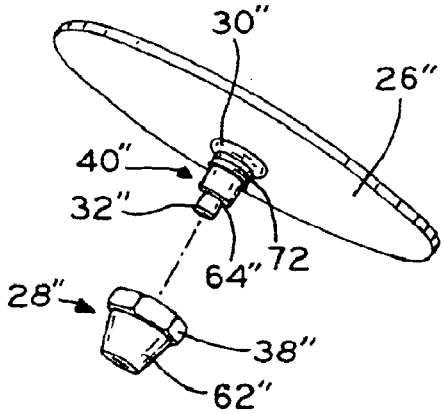

O-ring 30" is next positioned about threaded intermediate section 72 of adaptor 68 as illustrated in FIG. 14. Finally, internal threads 35 (FIG. 10) of nozzle 28" are threadedly engaged with threaded intermediate section 72 of adaptor 68 as illustrated in FIGS. 10 and 15. As illustrated in FIG. 10, nozzle insert 40" is positioned intermediate adaptor 68 and nozzle 28", with nozzle tip 32" extending approximately 1 to 2 millimeters from nozzle 28".

The embodiment illustrated in FIGS. 11–15 advantageously restrains nozzle insert 40" from axial displacement toward shower head 20 (FIG. 1). With the exception of the mechanism of attachment, nozzle 28" and the associated nozzle insert 40" are in all other respects identical to nozzle 28 and nozzle insert 40 discussed above.

While this invention has been described as having a preferred design, the present invention can be further modified within the spirit and scope of this disclosure. The application is therefore intended to cover any variations, uses, or adaptations of the invention using its general principles. Further, this application is intended to cover such departures from the present disclosure as come within known or customary practice and the art to which this invention pertains and which fall within the limits of the appended claims.

What is claimed is:

1. A shower head assembly, comprising:

a shower head housing having a water inlet and a nozzle plate, said nozzle plate having a plurality of apertures therein;

a plurality of nozzles positioned on said shower head housing in fluid communication with said apertures to provide a plurality of water outlets;

a plurality of nozzle inserts, each of said nozzles having a nozzle insert positioned therein, each of said nozzle inserts having a flexible nozzle tip protruding from said nozzle, each of said nozzle inserts having a passageway in fluid communication with said water inlet, whereby water introduced into said water inlet is ejected from the shower head through said passageway in said nozzle insert; and a plurality of adaptors, each said nozzle secured to an adaptor, each of said plurality of nozzle inserts positioned intermediate one of said plurality of adaptors and one of said plurality of nozzles, wherein said nozzle insert is formed from an outer sleeve surrounding an inner cannulated member having said passageway formed therein.

2. The shower head assembly of claim 1, wherein said nozzle insert comprises a co-injected part, with said outer sleeve formed over said inner cannulated member.

3. The shower head assembly of claim 1, wherein said outer sleeve is formed of a harder material than said inner cannulated member.

4. The shower head assembly of claim 1, wherein said inner cannulated member is formed from a material having a shore hardness of about 30–50 Sh A.

5. The shower head assembly of claim 1, wherein said outer sleeve is formed from a material having a shore hardness of about 90 Sh A.

6. The shower head assembly of claim 1, wherein said outer sleeve is formed from a polypropylene material.

7. The shower head assembly of claim 6, wherein said inner cannulated member is formed from a polypropylene material.

8. The shower head assembly of claim 1, wherein said inner cannulated member is formed from a polypropylene material.

9. A shower head assembly, comprising:

a shower head housing having a water inlet and a nozzle plate, said nozzle plate having a plurality of apertures therein;

a plurality of nozzles positioned on said shower head housing in fluid communication with said apertures to provide a plurality of water outlets;

a plurality of nozzle inserts, each of said nozzles having a nozzle insert positioned therein, each of said nozzle inserts having a flexible nozzle tip protruding from said nozzle, each of said nozzle inserts having a passageway in fluid communication with said water inlet, whereby water introduced into said water inlet is ejected from the shower head through said passageway in said nozzle insert; and a plurality of adaptors, each said nozzle secured to an adaptor, each of said plurality of nozzle inserts positioned intermediate one of said plurality of adaptors and one of said plurality of nozzles, wherein said nozzle and said shower head have a consistent finish.

10. The shower head assembly of claim 9, wherein said consistent finish comprises a brass finish.

11. The shower head assembly of claim 9, wherein said consistent finish comprises a chrome finish.

12. The shower head assembly of claim 9, wherein said nozzle insert comprises a co-injected part, with said outer sleeve formed over said inner cannulated member.

13. The shower head assembly of claim 9, wherein said outer sleeve is formed of a harder material than said inner cannulated member.

14. The shower head assembly of claim 9, wherein said inner cannulated member is formed from a material having a shore hardness of about 30–50 Sh A.

15. The shower head assembly of claim 9, wherein said outer sleeve is formed from a material having a shore hardness of about 90 Sh A.

16. A shower head nozzle assembly, comprising:

a nozzle body having a nozzle insert passageway formed therein;

a nozzle insert positioned in said nozzle insert passageway of said nozzle body, said nozzle insert including a flexible nozzle tip protruding from said nozzle, said nozzle insert being cannulated, whereby water introduced into said nozzle traverses said nozzle insert and is ejected therefrom;

an adaptor, said nozzle body secured to said adaptor with said nozzle insert positioned intermediate said adaptor and said nozzle, wherein said nozzle insert is formed from an outer sleeve surrounding an inner cannulated member having said passageway formed therein.

17. The shower head nozzle assembly of claim 16, wherein said nozzle insert comprises a co-injected part, with said outer sleeve formed over said inner cannulated member.

18. The shower head nozzle assembly of claim 16, wherein said outer sleeve is formed of a harder material than said inner cannulated member.

19. The shower head nozzle assembly of claim 16, wherein said inner cannulated member is formed from a material having a shore hardness of about 30–50 Sh A.

20. The shower head nozzle assembly of claim 16, wherein said outer sleeve is formed from a material having a shore hardness of about 90 Sh A.

21. The shower head nozzle assembly of claim 16, wherein said outer sleeve is formed from a polypropylene material.

* * * * *